US005924891A

United States Patent [19]

Benjamin et al.

[11] Patent Number: 5,924,891

[45] Date of Patent: Jul. 20, 1999

[54] CONNECTOR ASSEMBLY FOR FLAT CIRCUITRY

[75] Inventors: Karen Elizabeth Benjamin, Harrisburg; John Lawrence Broschard, III, Hershey; Brent David Yohn, Newport, all of Pa.

[73] Assignee: The Whitaker Corporation, Wilmington, Del.

[21] Appl. No.: 08/990,403

[22] Filed: Dec. 15, 1997

[51] Int. Cl.[6] ..... H01R 9/07

[52] U.S. Cl. ..... 439/495

[58] Field of Search ..... 439/495, 496, 439/499, 470, 492, 493, 327, 67, 77

[56] References Cited

U.S. PATENT DOCUMENTS

| | | | |
|---|---|---|---|
| 3,851,294 | 11/1974 | Palazzetti et al. | 339/17 F |
| 4,017,138 | 4/1977 | Evans | 339/75 MP |
| 4,367,006 | 1/1983 | Rehbogen, Jr. et al. | 339/176 MF |
| 4,406,551 | 9/1983 | Hayes | 339/103 M |
| 4,629,271 | 12/1986 | Awano | 339/75 MP |
| 4,639,063 | 1/1987 | Mueller | 339/75 M |
| 4,713,020 | 12/1987 | Awano et al. | 439/267 |
| 4,718,859 | 1/1988 | Gardner | 439/329 |
| 4,778,403 | 10/1988 | Ikesugi et al. | 439/329 |
| 5,061,205 | 10/1991 | Toramoto | 439/493 |
| 5,074,806 | 12/1991 | Korsunsky et al. | 439/497 |
| 5,106,311 | 4/1992 | Yodogawa et al. | 439/77 |
| 5,194,017 | 3/1993 | Consoli | 439/492 |
| 5,306,162 | 4/1994 | Armendariz | 439/67 |
| 5,354,214 | 10/1994 | Aso et al. | 439/492 |
| 5,401,186 | 3/1995 | Nozaki et al. | 439/495 |
| 5,514,008 | 5/1996 | Kocher et al. | 439/495 |

OTHER PUBLICATIONS

All about J.S.T., vol. 4, Jul. 1988, catalog—no author, pages 59 and 60.

*Primary Examiner*—Paula Bradley
*Assistant Examiner*—Tho D. Ta
*Attorney, Agent, or Firm*—Katherine A. Nelson; Anton P. Ness

[57] ABSTRACT

An electrical connector assembly (10) for flexible film circuitry (70) includes an insulative housing (14) having a film-receiving cavity (40) extending into a circuitry-receiving face (16) thereof, and further including flanges (30) at opposed ends of the cavity (40); and a locking bar (50) extending between the flanges (30) and affixed to the housing (14) to one side (41) of cavity (40) in a manner permitting movement toward and away from an opposed side (42) of the cavity (40). The locking bar (50) includes at least one projection (54) to be received through a corresponding hole (78) of the flexible film circuitry (70) upon full insertion of the circuitry into the cavity and actuation of the locking bar (50) to a locking position. The locking bar (50) includes ears (56) adjacent the flanges (30) that cooperate with the flanges (30) to define unactuated and actuated positions of the locking bar (50).

8 Claims, 5 Drawing Sheets

CONNECTOR ASSEMBLY FOR FLAT CIRCUITRY

FIELD OF THE INVENTION

This invention relates to connectors for flat circuitry and more particularly to connectors for use with flat flexible film circuitry.

BACKGROUND OF THE INVENTION

When using connectors that must be removably connected to flat cable, particularly flat flexible film circuitry, it is desirable to provide a strain relief or other device to prevent the cable from being inadvertently pulled from the connector. U.S. Pat. No. 4,406,511 discloses a flat cable connector having a strain relief for securing a cable in the housing. The strain relief is a member having a rigid body portion with resilient latching arms that are engagable with end walls of the housing. A pair of cable-retaining ears extend from the forward edge of the member and have free portions that are received in openings of the cable. The strain relief member is movable in a direction that is perpendicular to the flat flexible film circuitry and requires an amount of space above the connector housing and cable to permit application of and removal of the strain relief housing. It is desirable, however, to have a device for securing the cable in a connector and providing a locking mechanism or strain relief that adds little or no additional size to the connector and preferably a device that does not need to be completely removed from the connector.

U.S. Pat. No. 5,194,017 discloses a connector for a flexible cable that includes a two piece housing in which a first housing part includes a circuit receiving opening and the second housing part includes a stuffer portion that is moved into the first housing to force the flexible cable into electrical engagement with the terminals within the first housing. The first housing, therefore, must have a cable opening of sufficient depth to receive both the cable and the stuffer. This again, adds size to the connector housing.

SUMMARY OF THE INVENTION

The present invention is directed to a strain relief or locking bar that eliminates problems associated with the prior art. The connector includes a housing having flanges at opposed ends thereof, a circuitry or film-receiving cavity extending into a circuitry-receiving face of the housing, a plurality of terminals affixed in the housing with first contact sections exposed in the cavity, and a locking bar extending between the flanges to one side of the cavity and affixed to the housing to permit movement toward and away from an opposed side of the cavity along the circuitry-receiving face and outside the cavity. The locking bar and flexible circuitry cooperate with each other to secure the circuitry in the cavity when the locking bar is in its locked position. The locking bar further includes ears adjacent the flanges that cooperate to define unactuated and actuated positions of the locking bar such that the locking bar is affixed to the housing in both the actuated and unactuated positions.

In one embodiment, the locking bar includes an embossment on each ear that is insertable into first and second detents on the housing flanges to define the actuated and unactuated positions. Each embossment includes a surface that is essentially perpendicular to the direction of travel of the locking bar. This surface faces away from the cavity and the locking bar. Each of the second detents includes a cooperating essentially perpendicular surface facing the cavity and locking bar to abut the embossment flat surface to stop the locking bar movement when moved to the unactuated position.

In one embodiment, the locking bar includes at least one projection extending toward an opposed side of the cavity to be received in a hole in the flexible film circuitry upon full insertion of the end of the circuitry into the cavity and actuation of the locking bar to a locked position to lock the circuitry in the housing. It is to be understood that other cooperating features, such as notches in the circuitry and corresponding projections on the locking bar, may also be used to secure the circuitry in the cavity.

An embodiment of the invention will now be disclosed by way of example with reference to the following drawings.

DETAILED DESCRIPTION OF AN EMBODIMENT OF THE INVENTION

For purposes of illustrating the invention the locking bar assembly will be shown with a connector disclosed in U.S. Pat. No. 4,367,006, known as a Trio-Mate connector and sold by AMP Incorporated. It is to be understood that the locking bar is suitable for use with other connectors as well.

Figure 1:
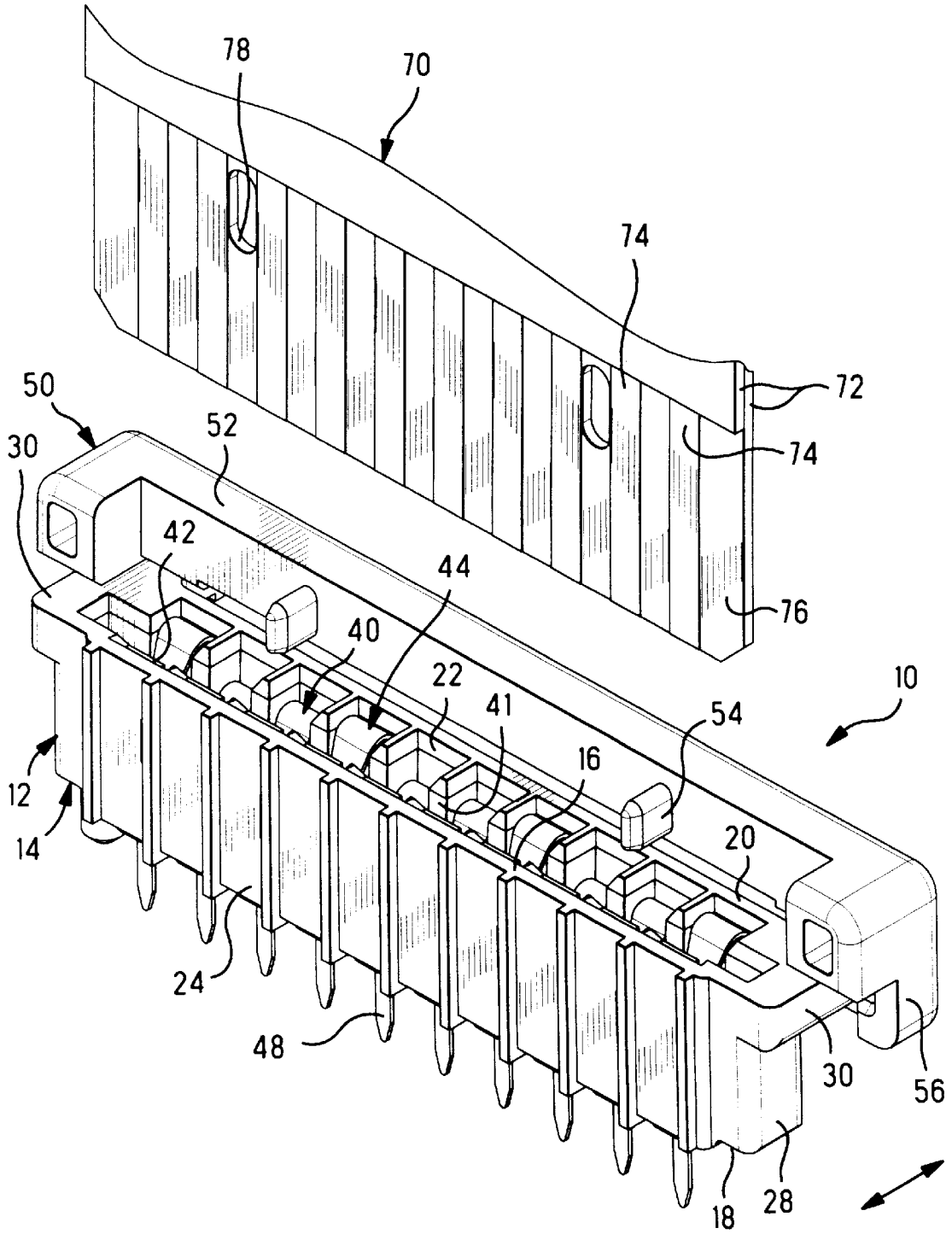
FIG. 1 is an isometric view of the connector and locking bar assembly with the flexible film circuitry exploded therefrom.
Figure 2:
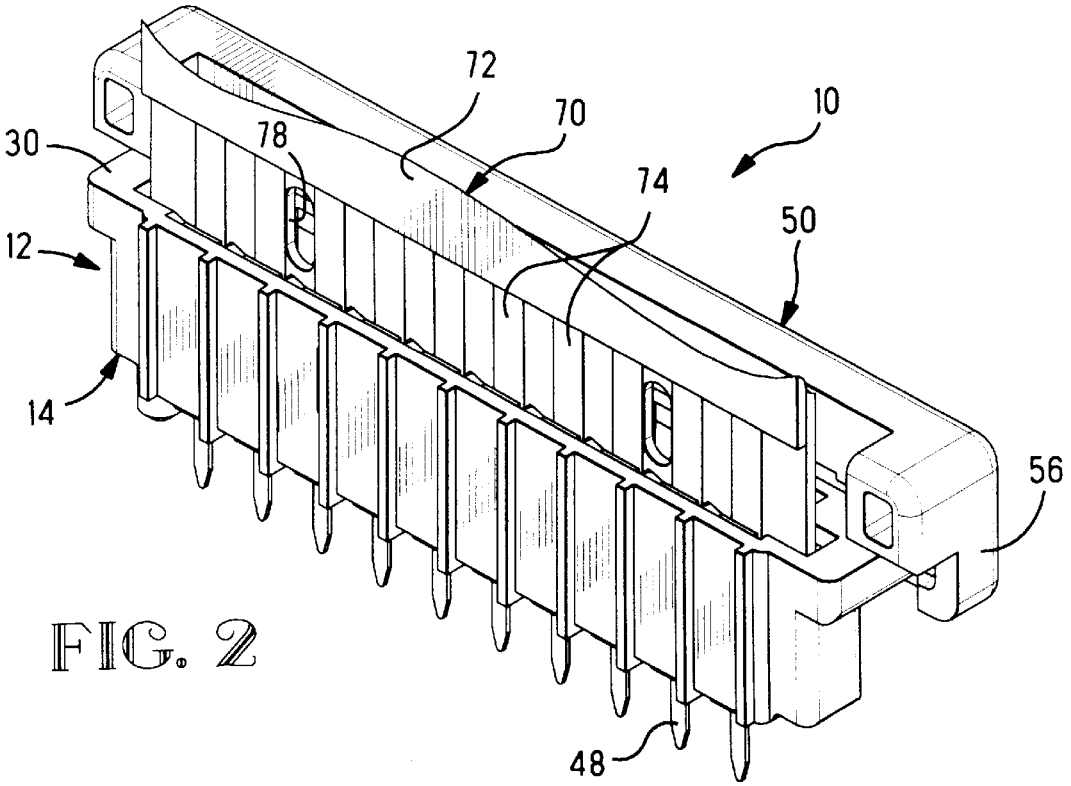
FIG. 2 is an isometric view similar to that of FIG. 1 with the flexible film circuitry inserted into the circuitry-receiving cavity and the locking bar in its unactuated position.
Figure 3:
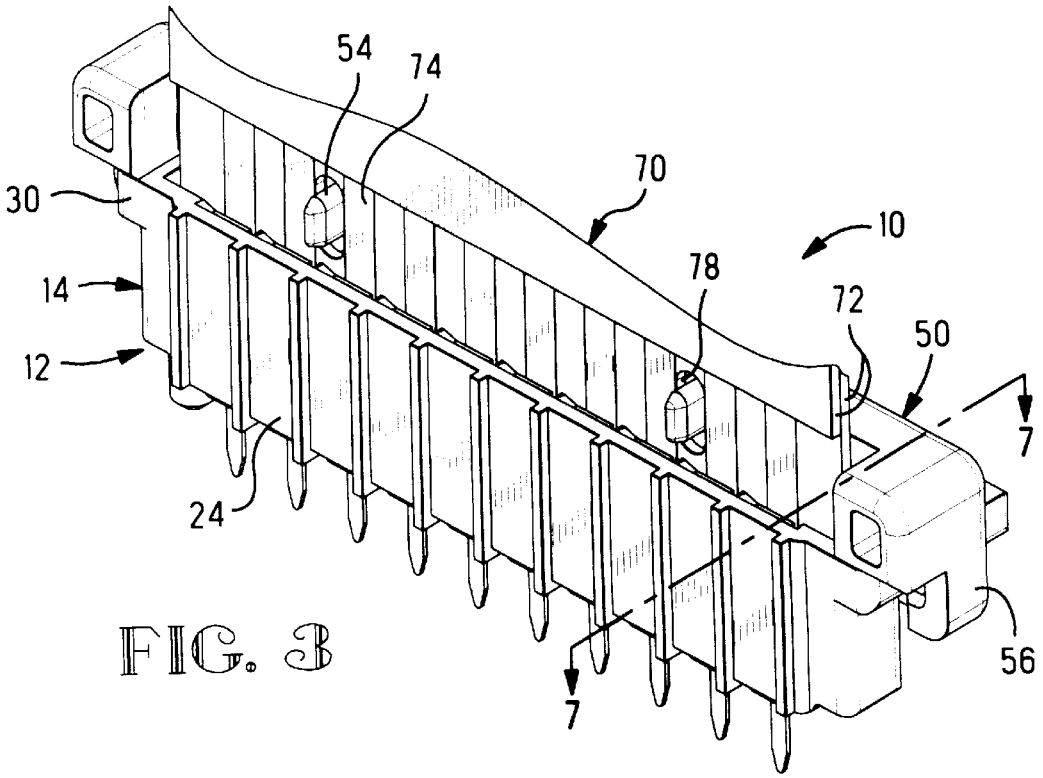
FIG. 3 is a view similar to FIG. 2 with the locking bar in its actuated position.
Figure 4:
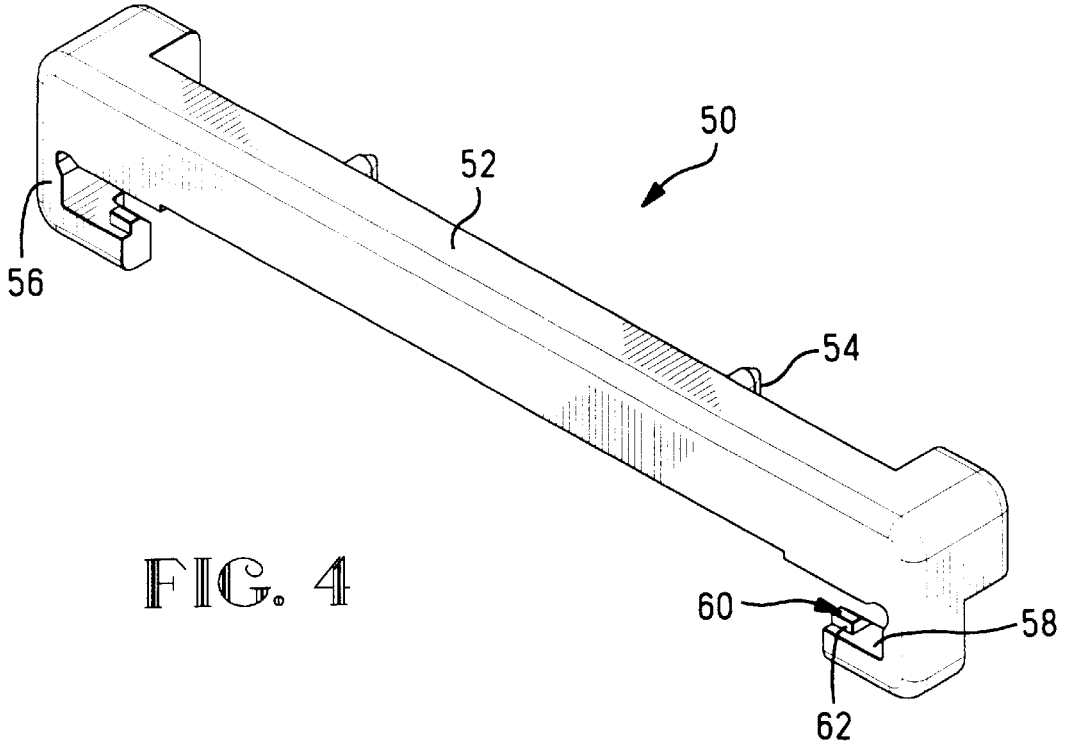
FIG. 4 is an isometric view of the locking bar illustrating the structure thereof.
Figure 5:
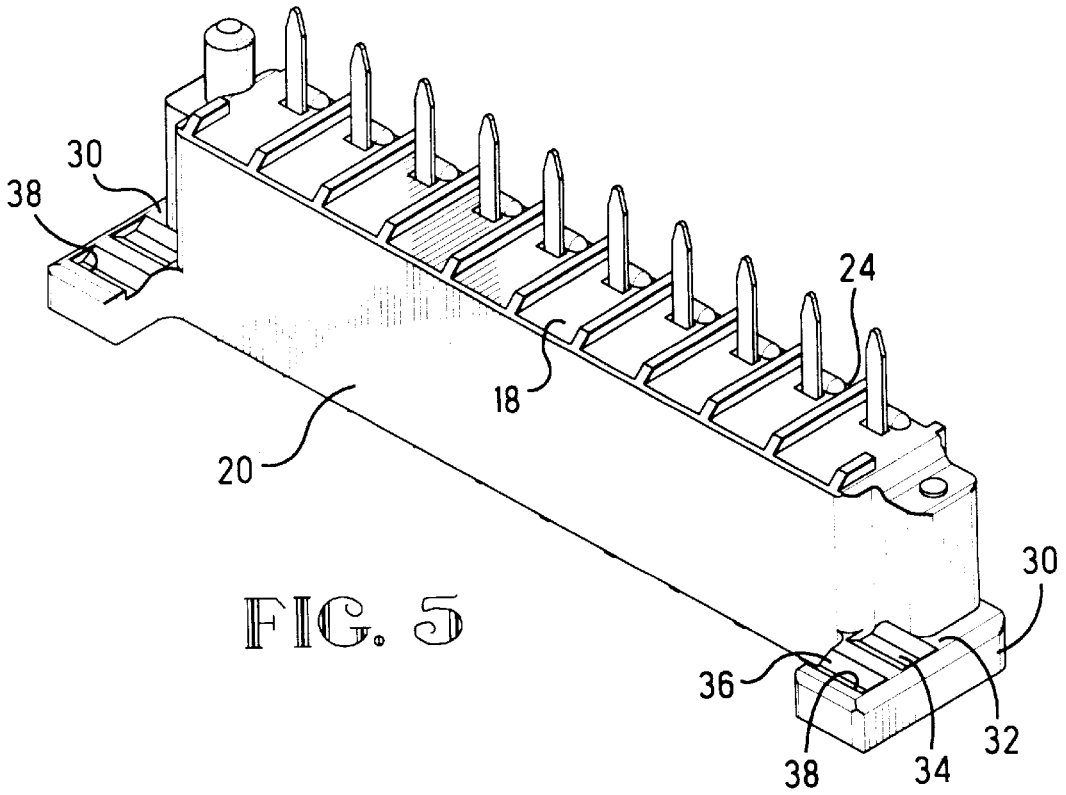
FIG. 5 is an isometric view of the connector as viewed from the bottom thereof.
Figure 6:
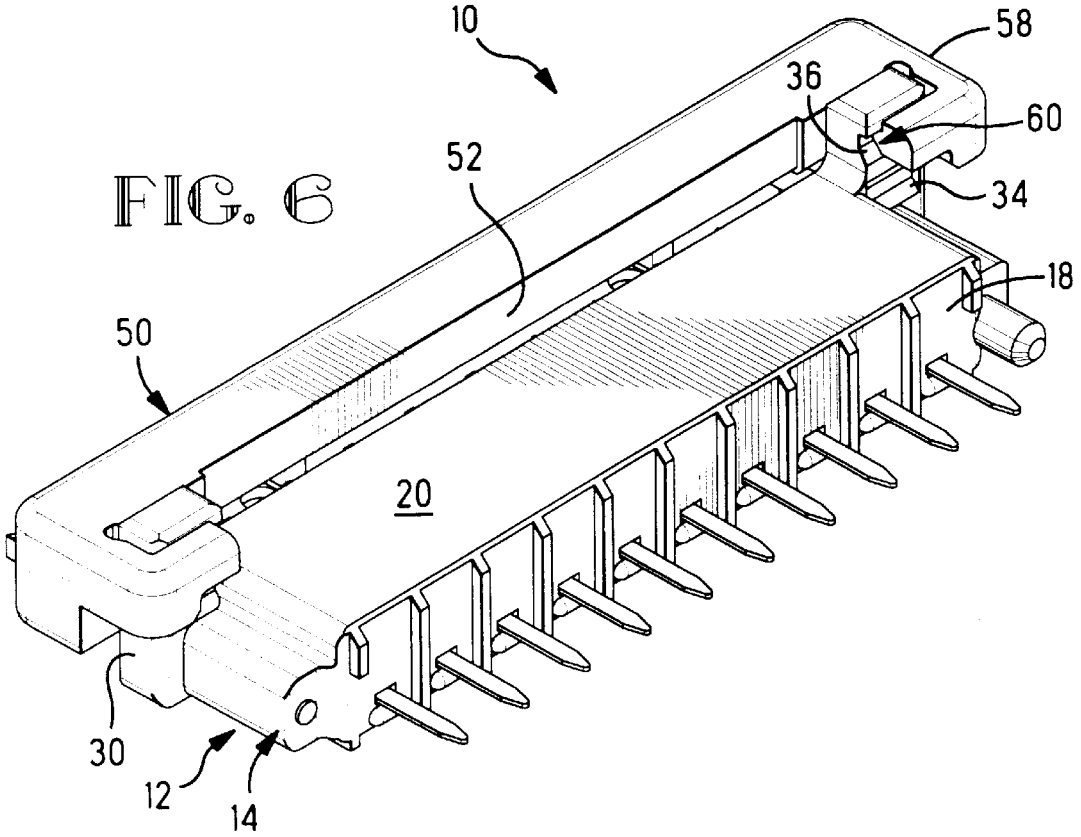
FIG. 6 is an isometric view of the connector assembly taken from the bottom thereof with the locking bar in its unactuated position.
Figure 7:
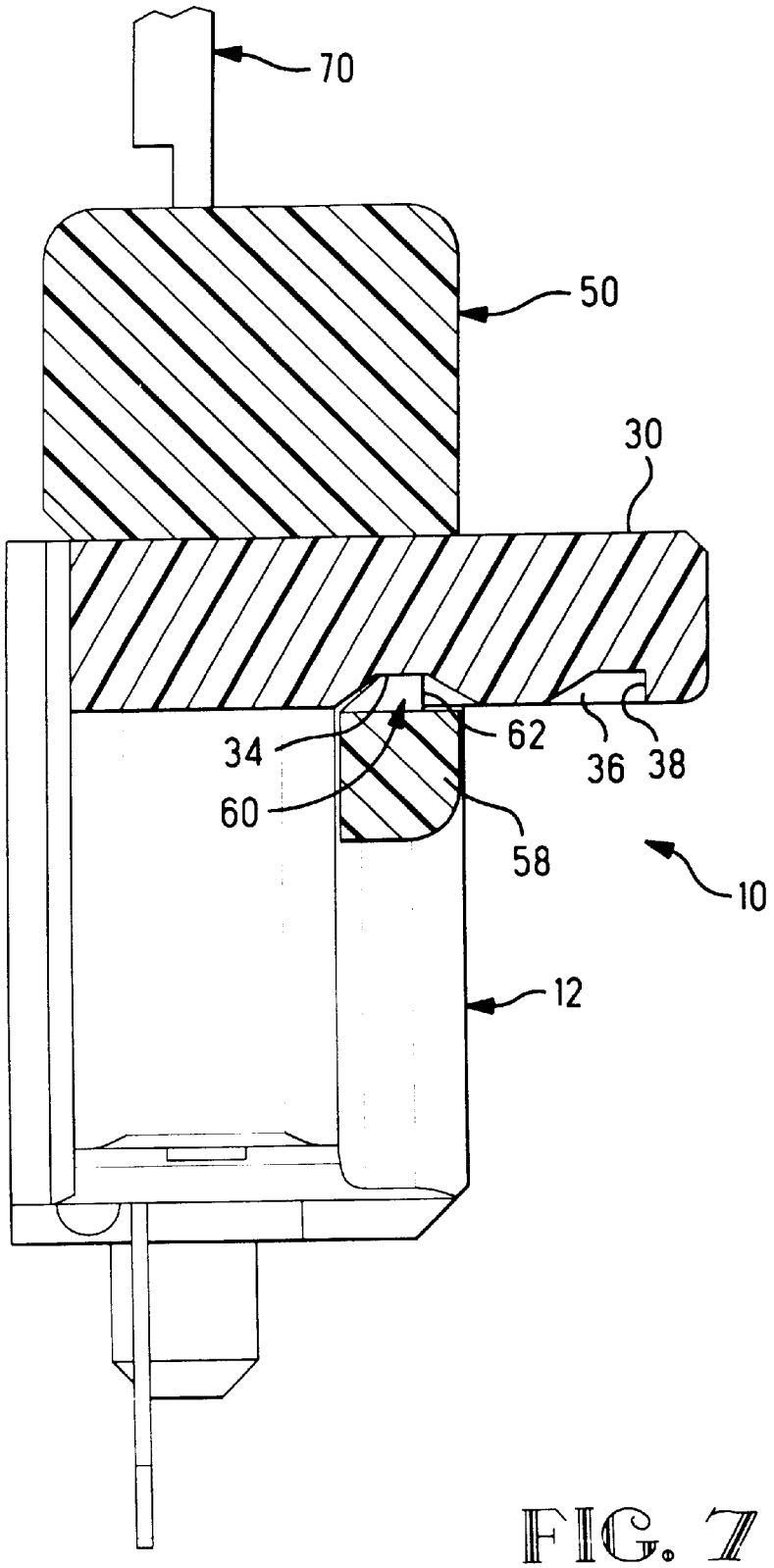
FIG. 7 is a sectional view taken along line 7—7 of FIG. 3.

Referring now to FIGS. 1 through 7, connector assembly 10 includes a connector 12 for flexible film circuitry and a locking bar 50 affixed to one side 41 of the circuitry-receiving cavity 40 of connector 12 and movable between actuated and unactuated positions. Connector 12 includes an insulated housing 14 having a circuitry-receiving face 16 and an opposed second face 18, opposed first and second side walls 20, 24, and end walls 28, together defining the circuitry or film-receiving cavity 40. As shown herein housing 14 further includes a plurality of terminal-receiving passageways 22 having terminals 44 disposed therein. The terminals 44 include a first contact section (not shown) extending into the film-receiving cavity 40 and a board mounting second contact section defining a board mounting portion 48 extending outwardly from the housing. In the embodiment shown, the opposed side or second face 18 of the connector 12 is a board mounting surface and the terminals include second contact sections 48 extending therefrom for board insertion. The end walls 28 include outwardly extending flanges 30 extending laterally of the terminals 44. Flanges 30 include first and second detents 34, 36, respectively, extending into surface 32 thereof, as best seen in FIGS. 5 and 7. The first detent 34 is spaced closer to the cavity 40 than is the second detent 36. The second detent 36 includes a flat surface 38 proximate the outer most edge of the flange 30 that is essentially perpendicular to the direction in which the locking bar 50 moves. The essentially perpendicular surface 38 faces cavity 40 and the locking bar 50, as best seen in FIGS. 5 and 7. In the embodiment shown, the remaining surfaces of the detents are tapered to permit the locking bar 50 to be moved between the two positions and additionally to allow the locking bar to move slightly sideways to accurately position protrusions 54 in apertures 78 of circuitry 70.

Locking bar 50 extends along the connector to one side 41 of cavity 40 and includes a flat bar portion 52 extending between flanges 30 and ears 56 extending rearwardly from ends thereof. The ears 56 of the locking bar 50 extend from the cable receiving face 16 to the second face 18 along outward edges of the flanges 30 and then toward each other and are at least partially wrapped around flanges 30, as best seen in FIG. 4. The ears 56 include surfaces 58, each having an embossment 60 thereon. Each embossment 60 includes an essentially perpendicular surface 62 facing away from cavity 40 and locking bar 50. The cooperating embossments 60 and detents 34, 36 cooperate to hold the locking bar 50 securely in both the actuated and unactuated positions. The cooperating perpendicular surfaces 62 of the embossment 60 and 38 of the second detent 36 cooperate to prevent the locking bar 50 from being removed easily from the connector 12. The positions of the detents 34, 36 and embossment 60 when the connector is in the actuated or locked position is shown in FIG. 7. The forward portion of the embossment 60 is tapered to allow the locking bar 50 to move freely between the two desired positions. Thus, the locking bar 50 will not slide off from the housing. While the embossments and detents are being shown with tapered substantially flat surfaces, it is to be understood that the embossments and detents may also be substantially hemispherical with the appropriate perpendicular flat surfaces. The flat bar-like portion 52 further includes a pair of projections 54 extending outwardly therefrom and adapted to be received in respective apertures 78 of the flexible film circuitry 70.

The flexible film circuitry 70, illustrated herein, includes two film layers 72 having a plurality of conductors 74 extending therebetween. One of film layers 72 is removed at the leading end 76 thereof, exposing conductors 74 for electrical connection to the first contact sections (not shown) of terminals 44 upon insertion of circuitry 70 into connector 12. The flexible circuitry 70 further includes a plurality of apertures 78 extending therethrough adapted to be received on the locking bar projections 54. It is to be understood that other configurations of flexible film circuitry may also be used and that the locking bar can be used with other connectors and more rigid circuit boards or the like.

The locking bar 50 is assembled to the connector 12 by positioning the locking bar portion 52 between the flanges 30 to one side 41 of the cavity 40 with the ears 56 wrapped around flanges 30. The locking bar 50 is thus affixed to the housing 14 in a manner permitting movement toward and away from an opposed side 42 of the cavity 40. In its unactuated position, the respective embossments 60 are received in the second detents 36 toward the outer end of the respective flanges 30. The projections 54 on the locking bar 50 extend toward the film-receiving cavity. The unactuated or unlocked position can best be seen by referring to FIGS. 1 and 6 and the actuated or locked position in FIGS. 3 and 7.

Upon inserting the flexible film circuitry into the film-receiving cavity 40, the apertures 78 are aligned with the projections 54 such that upon moving the locking bar 50 from the first or unactuated position into its second or actuated position, the respective embossments 60 are moved into the first detent 34 and concomitantly the projections 54 on the locking bar 50 are moved into the apertures 78 of the flexible film circuitry, as best seen in FIG. 3.

The present invention provides a locking bar that holds flexible film circuitry in an electrical connector that requires a minimum amount of space beyond that required for the connector itself. It further provides a locking bar that is movable between an unactuated and an actuated position and is secured to the housing in both positions. In assembling the connector, the locking bar is secured to the connector in its unactuated position and can be shipped to a customer in the unactuated position. The customer can then insert the circuitry and move the locking bar to its actuated position. The present assembly eliminates the need for two separate pieces that must be maintained in inventory and assembled after insertion of the flexible film circuitry.

It is thought that the flexible film circuitry connector and locking bar assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector assembly for flexible film circuitry, comprising:

an insulative housing including a film receiving cavity extending into a circuitry-receiving face thereof, said circuitry-receiving face defining a first face of said housing, and further including a plurality of terminals affixed in the housing with first contact sections exposed in said cavity to be electrically engaged with conductors of said flexible film circuitry;

flanges of said housing at opposed ends of said cavity laterally of said terminals; and a locking bar extending between said flanges to one side of said cavity and affixed to said housing in a manner permitting movement toward and away from an opposed side of said cavity along said circuitry-receiving face and outside said cavity, said locking bar and flexible film circuitry being adapted to cooperate with each other to lock said circuitry in said housing upon full insertion of said circuitry into said cavity and actuation of said locking bar to a locked position;

said locking bar including ears adjacent said flanges, said ears extend from a second face of said housing opposed to said first face, and said ears and said flanges cooperating to define unactuated and actuated positions of said locking bar, whereby said locking bar is affixed to said housing in said actuated and said unactuated positions.

2. The electrical connector assembly of claim 1 wherein said ears extend from said first face to said second face along outward edges of said flanges and then extend toward each other.

3. The electrical connector assembly of claim 1 wherein said locking bar includes at least one projection extending toward said opposed side to be received through a corresponding hole of said flexible film circuitry for locking said circuitry in said cavity when said locking bar is in its actuated position.

4. The electrical connector assembly of claim 3 wherein said locking bar includes two locking projections for said flexible film circuitry.

5. The electrical connector assembly of claim 1 wherein said locking bar includes embossments on respective said ears seatable in first and second detents on said flanges to define said actuated and unactuated positions.

6. The electrical connector assembly of claim 5 wherein said embossments each include an essentially perpendicular surface facing away from one side of said cavity and said second detent includes an essentially perpendicular surface facing said one side to abut said embossment perpendicular surface to stop said locking bar movement when moved to said unactuated position.

7. The electrical connector assembly of claim 1 wherein said second face of said housing is a board mounting surface and said terminals include second contact sections extending therealong for board insertion.

8. The electrical connector assembly of claim 7 wherein said terminals extend from said second face for board connection.

* * * * *